US005316516A

United States Patent [19]

Saitoh

[11] Patent Number: 5,316,516

[45] Date of Patent: May 31, 1994

[54] ANIMATED SINGING TOY BIRD WITH EXTERNAL STIMULUS SENSOR

[75] Inventor: Shinya Saitoh, Shiroi, Japan

[73] Assignee: Takara Co., Ltd., Tokyo, Japan

[21] Appl. No.: 917,485

[22] Filed: Jul. 20, 1992

[30] Foreign Application Priority Data

Apr. 21, 1992 [JP] Japan ..... 4-033480[U]
Jun. 3, 1992 [JP] Japan ..... 4-044413[U]

[51] Int. Cl.[5] ..... A63H 3/28; A63H 11/00

[52] U.S. Cl. ..... 446/175; 446/301; 446/298; 446/353; 40/414; 40/416

[58] Field of Search ..... 446/175, 14, 297, 298, 446/299, 353, 300, 301, 303, 354, 338; 40/414, 416, 457

[56] References Cited

U.S. PATENT DOCUMENTS 3,199,248 8/1965 Suzuki ..... 446/299
3,456,383 7/1969 Gardel et al. ..... 446/353
4,717,363 1/1988 Refabert ..... 446/14
4,913,676 4/1990 Koguchi et al. ..... 446/353 X
4,984,380 1/1991 Anderson ..... 446/175 X
5,052,970 10/1991 Balwigaire ..... 446/351

FOREIGN PATENT DOCUMENTS 2089225A 6/1982 United Kingdom .
2230469A 10/1990 United Kingdom .

*Primary Examiner*—Mickey Yu
*Attorney, Agent, or Firm*—Price, Gess & Ubell

[57] ABSTRACT

A toy bird capable of carrying out movement like a real bird. A body section is arranged so as to be longitudinally moved with respect to a leg section and a head section is arranged so as to be laterally moved with respect to the body section. In the body section is provided a driving unit for carrying out openable operation of a bill as well as the above-described movement of each of the body and head sections. Also, the toy body is constructed so as to generate sound like a song of a real bird. The toy bird can be actuated by an external stimulus sensor that can respond to sound, light, and the like.

5 Claims, 6 Drawing Sheets

ANIMATED SINGING TOY BIRD WITH EXTERNAL STIMULUS SENSOR

BACKGROUND OF THE INVENTION

This invention relates to a movable toy bird, and more particularly to a toy bird which is so constructed that body and head sections thereof are movable.

Conventionally, various kinds of toy birds have been proposed and put into practice. Also, a toy bird is recently proposed which is provided therein with a sound generating unit, so that a viewer may be impressed as if a bird twitters. Unfortunately, the conventional toy birds are substantially stationarily constructed. There has not been developed a movable toy bird which exhibits motion like a real bird.

SUMMARY OF THE INVENTION

The present invention has been made in view of the foregoing.

It is an object of the present invention to provide a toy bird which is clearly distinct from the conventional toy birds.

It is another object of the present invention to provide a toy bird which is capable of exhibiting motion like a real bird.

It is a further object of the present invention to provide a toy bird which is capable of exhibiting complicated motion.

It is still another object of the present invention to provide a toy bird which is capable of exhibiting motion sufficient to permit a viewer to take interest and/or surprise.

In accordance with the present invention, a toy bird is provided. The toy bird comprises a leg section, a body section arranged so as to be longitudinally moved with respect to the leg section, a head section arranged so as to be laterally moved with respect to the body section, and a driving unit arranged in the body section for actuating the body section and head section.

In a preferred embodiment of the present invention, the toy bird further includes an actuation means for actuating said driving unit. The actuation means may comprise a sensor for detecting an external stimulus and a control circuit.

In a preferred embodiment of the present invention, the toy bird further comprises a sound generating unit. The sound generating unit is actuated by the sensor.

In a preferred embodiment of the present invention, the sensor comprises a pyroelectric sensor.

In a preferred embodiment of the present invention, the control circuit includes a timer circuit which permits the driving unit and sound generating unit to be actuated for a predetermined period of time by the sensor.

In a preferred embodiment of the present invention, the head section includes a bill constructed so as to be openable.

In the toy bird of the present invention constructed as described above, operation of the driving unit permits the body section to be longitudinally moved with respect to the leg section and the head section to be laterally moved with respect to the body section while permitting the toy bird to producing sound. Thus, the toy bird of the present invention exhibits motion like a real bird to permit a viewer to take much interest. Also, it serves as a movable decoration due to a variation in configuration and appearance.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a toy bird according to the present invention will be described hereinafter with reference to the accompanying drawings.

Figure 1:
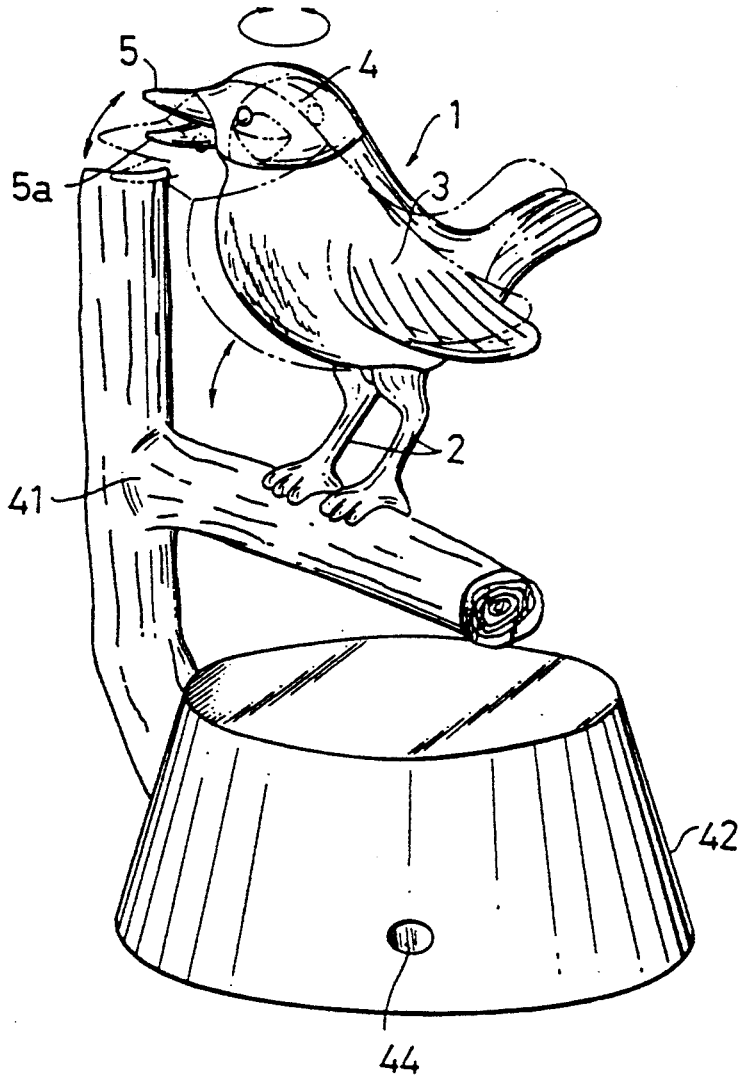
FIG. 1 is a perspective view showing a toy bird according to the present invention.

Referring first to FIG. 1, an embodiment of a toy bird according to the present invention is generally shown, in which a toy bird of the illustrated embodiment is generally indicated at reference numeral 1. The toy bird 1 generally includes a leg section 2 comprising a pair of legs, a body section 3 connected to the leg section 2 so as to be moved longitudinally or backward and forward with respect to the leg section 2, and a head section 4 connected to the body section 3 so as to be moved laterally or right and left with respect to the body section 3. The head section 4 is provided with a bill or beak (hereinafter referred to as "bill") 5, which is constructed so as to be openable. The body section 3 is provided therein with a driving unit 6 for driving the body section 3, head section 4 and bill 5.

Figure 2:
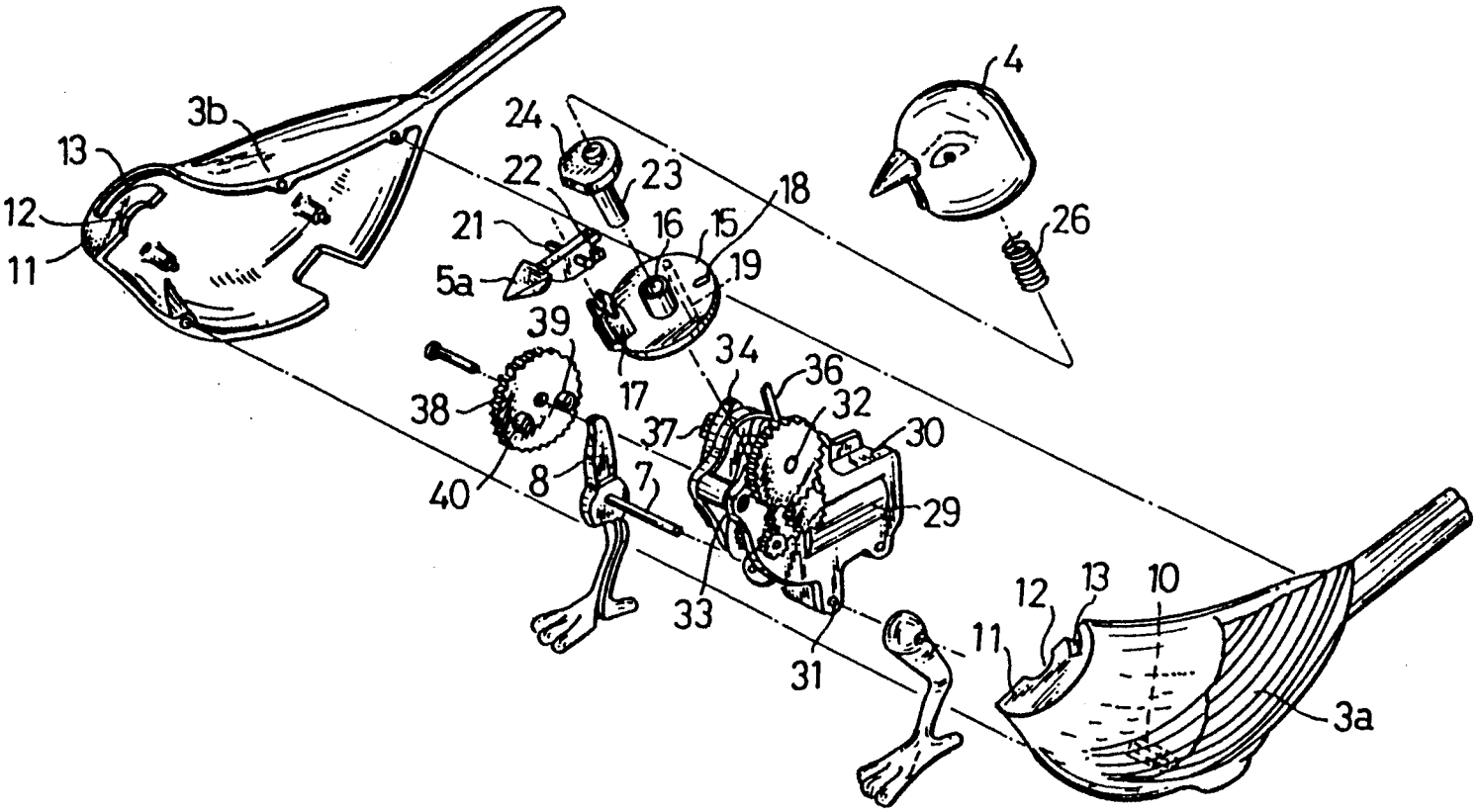
FIG. 2 is an exploded perspective view of the toy bird shown in FIG. 1.
Figure 3:
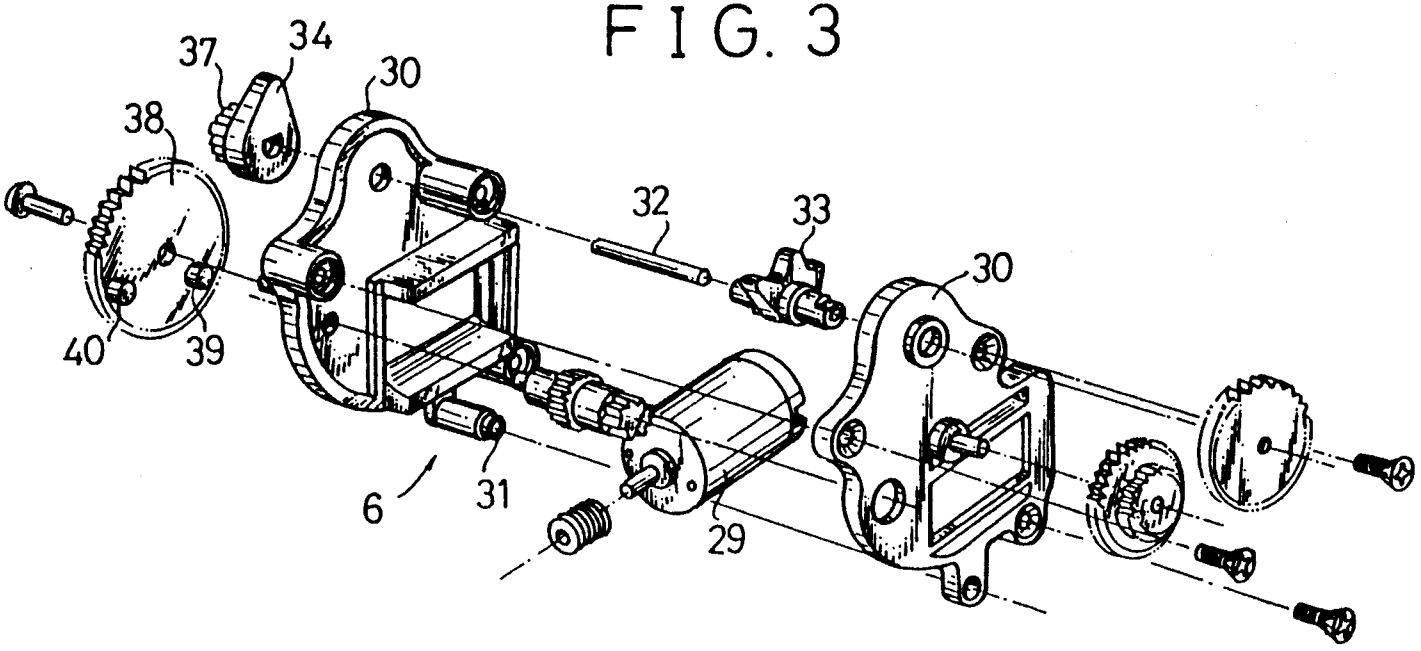
FIG. 3 is an exploded perspective view showing a driving unit incorporated in the toy bird shown in FIG. 1.

The legs constituting the leg section 2, as shown in FIG. 2, each are mounted at an upper portion thereof on a shaft member 7, resulting in being connected to each other through the shaft member 7 in a manner to be spaced at a predetermined interval from each other. The shaft member 7 is arranged so as to be laterally projected at one end thereof from one of the legs of the leg section 2. The other leg of the leg section 2 is provided at an upper portion thereof with an engagement element 8 vertically extending. The one end of the shaft member 7 projected from the one leg of the leg section 2 is loosely fitted in a bearing portion provided on an inside of the body section 3 as described hereinafter.

More particularly, the body section 3 comprises two body half members **3*a* and 3*b* joined to each other. One body half member 3*a* is formed on an inside of an abdominal region thereof with a bearing portion 10, in which the one end of the shaft member 7 is loosely fitted, so that the body section 3** may be longitudinally movable about the shaft member 7. Also, the body section 3 is provided at a portion thereof connected to the head section 4 with a plate member 11. The plate member 11 is formed at a central portion thereof with a through-hole 12 and at a rear portion thereof in proximity to the through-hole 12 with an arcuate guide slit 13.

The head section 4 connected to the body section 3 constructed as described above is securely mounted at a lower portion thereof with a disc 15, which has a hollow support cylinder 16 extending therethrough, a lower portion of which is loosely fitted in the through-hole 12 of the plate member 11 so as not to be disconnected therefrom. The disc 15 is provided at a center of a front portion on an upper surface thereof with a bearing portion 17 and at a rear portion on the upper surface with a through-hole 18. The disc 15 is provided on a lower surface thereof with an engagement rod 19 in a manner to be in proximity to the through-hole 18.

The bill 5 includes a lower bill member 5*a* arranged so as to be openable about a support pin 21, which is supported in the bearing 17 provided on the upper surface of the disc 15. The lower bill member 5*a* is formed at a rear end thereof with an engagement recess 22.

Reference numeral 23 designates a shaft member arranged so as to slidably extend through the hollow cylindrical shaft 16, of which a distal end is positioned in the head section 4 and securely mounted thereon with an engagement plate 24. The engagement plate 24 is engaged at a distal end thereof with the engagement recess 22 provided at the lower bill member 5*a*. Also, the shaft member 23 has a rear end positioned in the body section 3, which is fixedly mounted thereon with an engagement element 25. The engagement plate 24 is provided on an upper surface thereof with an elastic member 26, which is abutted at an upper end thereof against an inner surface of an upper portion of the head section 4. Vertical movement of the shaft member 23 permits the lower bill member 5*a* to be openably operated about the support pin 21.

The driving unit 6 is housed in the body section 3 and arranged at a lower portion thereof between the legs of the leg section 2, as shown in FIG. 2. The driving unit 6 includes a frame assembly 30 on which a motor 29 and a reduction gear mechanism including a plurality of gears and driven by the motor 29 are supported. The frame assembly 30 is provided at a substantially center of a lower portion thereof with an inward extending elongated member formed with a through-hole 31, through which the shaft member 7 for connecting the legs of the leg section 2 therethrough to each other is loosely inserted. A shaft 32 of gear constituting a part of the reduction gear mechanism is fixedly mounted thereon with cam members 33 and 34, and one cam member 33 is abutted against the engagement element 25 and the other cam member 34 is releasably abutted against the engagement rod 19 provided on the lower surface of the disc 15.

The frame assembly 30 is provided at a center of an upper portion thereof with a leaf spring 36 upward projecting therefrom. The leaf spring 36 is arranged so as to be upward projected through the arcuate guide slit 13 of the plate member 11 of the body section 2 and the through-hole 18 of the disc 15 and constantly forces the head section 4 in a direction of returning the head section 4 to the original whenever it is moved.

The cam member 34 is fixedly mounted on an outer side thereof with another gear constituting a part of the reduction gear mechanism in a manner to be coaxial with the cam member 34, which gear is designated at reference numeral 37. The gear 37 is engaged with a gear 38. The gear 38 is provided on a periphery of an inner surface thereof with engagement pins 39 and 40 in a manner to be spaced at a predetermined interval from each other, which are adapted to be abuttedly engaged with the engagement element 8 of the leg section 2 while forcing it, resulting in the body section 3 being longitudinally moved.

Figure 7:
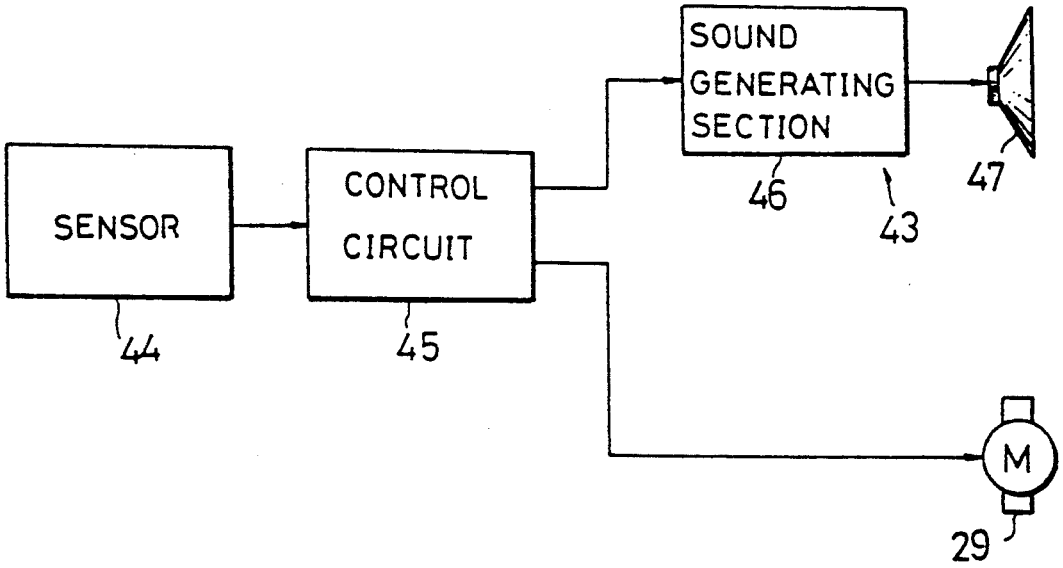
FIG. 7 is a block diagram showing actuation of the toy body shown in FIG. 1.

The toy bird of the illustrated embodiment constructed as described above is placed on a perch 41 fixed on a base 42 and the leg section 2 is fixed on the perch using a suitable means, as shown in FIG. 1. The base 42 is provided therein with a sound generating unit 43, a sensor 44 adapted to detect a predetermined external stimulus such as sound or the like and a control circuit 45. The sensor 44 may comprise, for example, a pyroelectric sensor for detecting infrared rays radiated from a human body and be arranged in a manner to be externally exposed through an aperture formed at the base 42. The control circuit 45 includes a timer circuit and is electrically connected to the sensor 44, motor 29 and sound generating unit 43, as shown in FIG. 7. The sound generating unit 43 includes a sound generating section 46 electrically connected to the control circuit 45 and a speaker 47 electrically connected to the sound generating section 46. The sound generating unit 43 may be constructed so as to generate sound like a song or twitter of a real bird. The song or twitter may be determined depending on a type of the toy bird.

In the toy bird of the illustrated embodiment constructed as described above, when a person goes past or approaches the toy bird, the pyroelectric sensor detects infrared rays emitted from him to cause the control circuit 45 to actuate the motor 29 and sound generating unit 43 for a predetermined period of time, resulting in the predetermined motion of each part of the toy bird being carried out through the driving unit 6 and a song of the toy bird being produced from the speaker 47.

Now, the manner of operation of each part of the toy bird 1 will be described hereinafter.

When the motor 29 of the driving unit 6 is controllably actuated, the reduction gear mechanism comprising a plurality of gears is actuated, so that the cam members 33 and 34 mounted on the gear shaft 32 are rotated. This causes the cam member 33 to be abutted against a rear end of the shaft member 23. The engagement plate 24 provided at the distal end of the shaft member 23 is engaged with a proximal end of the lower bill member 5*a*, so that rotation of the cam member 33 causes the shaft member 23 to be vertically moved, resulting in the lower bill member 5*a*being openably operated against elastic force of the elastic member 26.

The other cam member 34 is selectively engaged with the downward extending engagement rod 19 mounted on the disc 15 arranged in the lower portion of the head section 4, so that when the cam member 34 is engaged with the engagement rod 19 to force it, the head section 4 is moved about the support cylinder 16 in a left direction in FIG. 1 against the leaf spring 36. Then, when the cam member 34 is disengaged from the engagement rod 19, the head section 4 is returned to the original position by means of the leaf spring 36.

Figure 4:
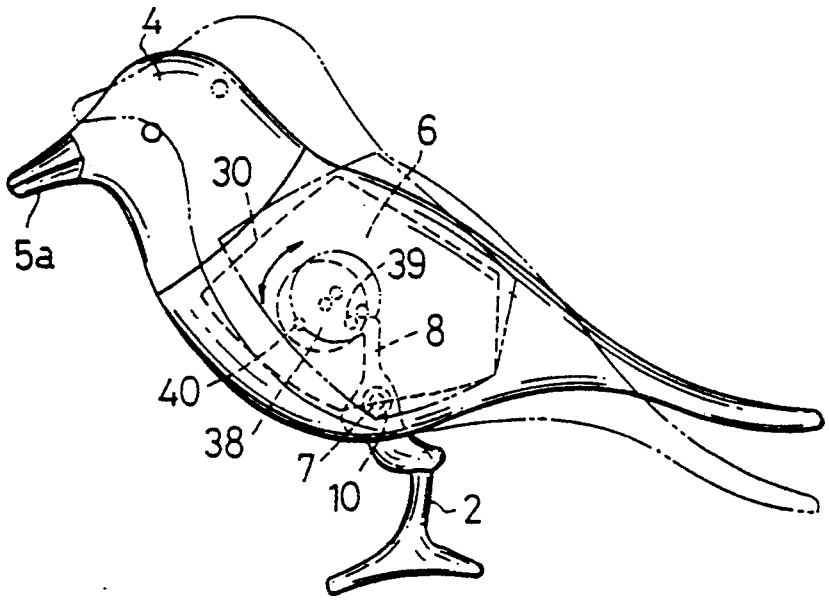
FIG. 4 is a schematic side elevation view showing longitudinal motion of a body section with respect to a leg portion.
Figure 5:
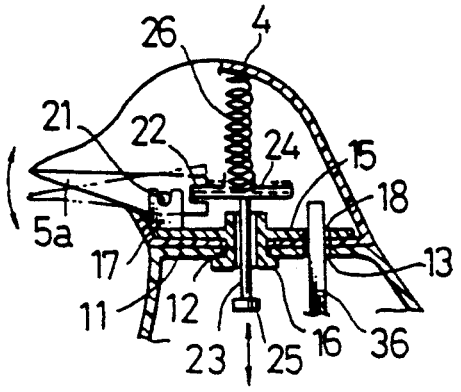
FIG. 5 is a fragmentary vertical sectional view showing an internal structure of a head section.
Figure 6:
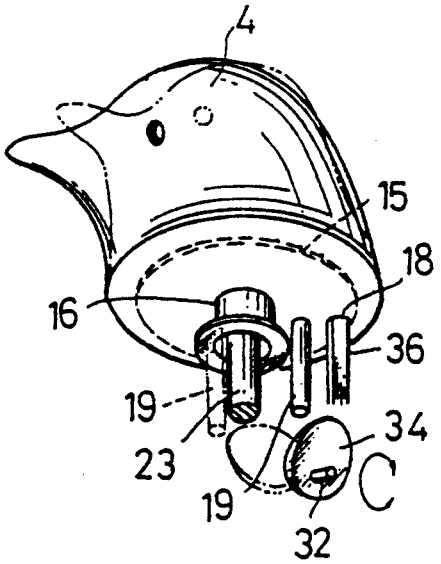
FIG. 6 is a fragmentary perspective view showing a head section and a cam mechanism for actuating the head section.

Further, when the gear 38 is rotated, the engagement pins 39 and 40 projectedly provided on the inner surface of the gear 38 repeat engagement with and disengagement from the engagement element 8 of the leg section 2, so that the body section 3 may be longitudinally moved about the shaft member 7 together with the frame assembly 30 on which the driving unit 6 is supported, as shown in FIG. 4.

As can be seen from the foregoing, the toy bird 1 of the present invention is so constructed that actuation of the driving unit 6 permits the body section 3 to be longitudinally moved with respect to the leg section 2 and concurrently the head section 4 to be laterally moved with respect to the body section 3. Concurrently, the lower bill member 5a of the bill 5 is openably or pivotally operated. Thus, the toy bird 1 exhibits motion like a real bird, to thereby permit a viewer to take interest and surprise. Also, the toy bird exhibits aesthetic properties sufficient to be used as a decoration. Further, arrangement of the sensor in the toy bird permits the driving unit and/or sound generating unit to be actuated, so that the viewer may take pleasure in hearing the sound as well.

The motor 29 of the driving unit 6 and the sound generating unit 43 may be constructed so as to be actuated in association with a sensor switch adapted to be actuated by sound, light or the like. Also, the sound generating unit may be constructed so as to generate a song or twitter depending on or corresponding to movement of the toy bird 1.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A toy bird comprising:

a leg section including a pair of legs;

a body section arranged so as to be longitudinally moved with respect to said leg section;

a head section arranged so as to be rotatably moved with respect to said body section;

a driving unit arranged in said body section and including a motor with an output shaft for actuating said body section and head section; and an actuating means for actuating said driving unit;

said actuating means including a sensor for detecting an external stimulus and a control circuit electrically connected to said driving unit and said sensor;

said driving unit including a first rotating shaft operatively coupled with the output shaft of said motor, first and second cam members being mounted on said first shaft, respectively, and a third cam member being drivingly connected to said first shaft and arranged so as to rotate about an axis parallel to said first shaft;

said head section including a bill constructed so as to be openable, an engagement rod fixed to a lower portion of said head section and extending downwardly therefrom, and a vertically movable shaft member connected to said bill, said engagement rod being at the lower end thereof disengageably abutted against an outer surface of said first cam member, said shaft member being abutted at the lower end thereof against an outer surface of said second cam member;

one of said pair of legs being provided at an upper portion thereof with an engagement element which repeatedly engages with and disengages from said third cam member during rotation of said third cam member.

2. A toy bird as defined in claim 1, further comprising a sound generating unit;

said sound generating unit being actuated by said sensor.

3. A toy bird as defined in claim 2, wherein said control circuit includes a timer circuit which permits said driving unit and sound generating unit to be actuated for a predetermined period of time by said sensor.

4. A toy bird as defined in claim 2, wherein said sensor comprises a pyroelectric sensor.

5. A toy bird assembly comprising:

a base support simulating a perch position;

a leg section including a pair of legs mounted on said perch position;

a body section arranged so as to be longitudinally moved with respect to said leg section;

a head section arranged so as to be rotatably moved with respect to said body section;

a driving unit arranged in said body section and including a motor with an output shaft for actuating said body section and head section; and an actuating means for actuating said driving unit;

said actuating means including a sensor for detecting a light stimulus mounted in the base support and a control circuit electrically connected to said driving unit and said sensor;

said driving unit including a first rotating shaft operatively coupled with the output shaft of said motor, first and second cam members being mounted on said first shaft, respectively, and a third cam member being drivingly connected to said first shaft and arranged so as to rotate about an axis parallel to said first shaft;

said head section including a bill constructed so as to be openable, an engagement rod fixed to a lower portion of said head section and extending downwardly therefrom, and a vertically movable shaft member connected to said bill, said engagement rod being at the lower end thereof disengageably abutted against an outer surface of said first cam member, said shaft member being abutted at the lower end thereof against an outer surface of said second cam member;

one of said pair of legs being provided at an upper portion thereof with an engagement element which repeatedly engages with and disengages from said third cam member during rotation of said third cam member.

* * * * *